US009138890B2

(12) United States Patent
Lee

(10) Patent No.: US 9,138,890 B2
(45) Date of Patent: Sep. 22, 2015

(54) HAND TOOL PART HOLDING DEVICE

(71) Applicant: Hong-Jen Lee, Taichung (TW)

(72) Inventor: Hong-Jen Lee, Taichung (TW)

( * ) Notice: Subject to any disclaimer, the term of this patent is extended or adjusted under 35 U.S.C. 154(b) by 48 days.

(21) Appl. No.: 14/105,199

(22) Filed: Dec. 13, 2013

(65) Prior Publication Data

US 2015/0165615 A1 Jun. 18, 2015

(51) Int. Cl.

| | |
|---|---|
| ***B25H 3/00*** | (2006.01) |
| ***B65D 25/22*** | (2006.01) |
| ***B65D 25/10*** | (2006.01) |

(52) U.S. Cl.

CPC ..... *B25H 3/003* (2013.01); *B65D 25/108* (2013.01); *B65D 25/22* (2013.01)

(58) Field of Classification Search

CPC .. B65D 5/4208; B65D 73/0064; B65D 85/20; B25H 3/04; B25H 3/003; B25H 3/00; A47F 5/0838

USPC ..... 206/349, 378, 377, 376, 372, 373, 806, 206/493, 480, 478; 211/70.6

See application file for complete search history.

(56) References Cited

U.S. PATENT DOCUMENTS

| | | | | |
|---|---|---|---|---|
| 4,941,571 | A * | 7/1990 | Barrett et al. | 206/378 |
| 6,092,656 | A * | 7/2000 | Ernst | 206/378 |
| 6,168,018 | B1 * | 1/2001 | Ramsey et al. | 206/378 |
| 6,415,933 | B1 * | 7/2002 | Kao | 211/70.6 |
| 7,111,422 | B2 * | 9/2006 | Wheeler | 40/617 |
| 7,118,406 | B2 * | 10/2006 | Mu et al. | 439/419 |
| 8,181,780 | B1 * | 5/2012 | Guffey et al. | 206/378 |
| 8,381,905 | B1 * | 2/2013 | Kao | 206/378 |
| 8,448,787 | B1 * | 5/2013 | Chang | 206/378 |
| 8,556,075 | B1 * | 10/2013 | Ou | 206/378 |
| 8,573,413 | B2 * | 11/2013 | Sh | 211/70.6 |
| 8,864,097 | B2 * | 10/2014 | Wang | 248/551 |
| 2003/0141211 | A1 * | 7/2003 | Tsai | 206/378 |
| 2005/0230587 | A1 * | 10/2005 | Yang | 248/314 |
| 2006/0254940 | A1 * | 11/2006 | Mu et al. | 206/378 |
| 2009/0145865 | A1 * | 6/2009 | Yu | 211/70.6 |
| 2010/0170817 | A1 * | 7/2010 | Wu | 206/378 |
| 2012/0061339 | A1 * | 3/2012 | Chang | 211/70.6 |

* cited by examiner

*Primary Examiner* — Steven A. Reynolds

(57) ABSTRACT

A hand tool part holding device includes a holding member having two posts. Each post is a T-shaped post and has two first holding portions and a second holding portion. The two respective second holding portion of the two posts are located away from each other. Each of the posts has two first slots defined in the outside thereof, and a second slot is defined between the two posts. Each post has a first engaging portion and a second engaging portion formed on the outside thereof. The first engaging portion is located close to the distal end of the post and positions a hand tool part which can be separated from the first engaging portion with a less force. The second engaging portion is an annular flange which secures the hand tool part which can be separated from the second engaging portion with a larger force.

5 Claims, 9 Drawing Sheets

HAND TOOL PART HOLDING DEVICE

BACKGROUND OF THE INVENTION

1. Fields of the invention

The present invention relates to a hand tool part holding device, and more particularly, to a hand tool part holding device which holds the hand tool part in two different ways.

2. Descriptions of Related Art

The conventional socket holding device is disclosed in U.S. Pat. No. 8,181,780 which is designed for holding sockets, extension rods, connectors or universal connectors. The holding device has a post and the socket has a rectangular recess with which the post is engaged. The post is a plastic made, cylindrical member and has an annular protrusion on the outside thereof. The sockets, extension rods, connectors or universal connectors each has a rectangular recess and a notch is defined in the inside of the rectangular recess so that the annular protrusion is engaged with the notch. The socket is mounted to the post and is convenient for storage. The conventional storage device is a frame with multiple posts, the sockets are mounted to the posts by engaging the notch with the annular protrusion so that the sockets are well secured on the posts and do not detach from the posts. The conventional post 3 is shown in FIG. 12. However, there is only one way to connect the socket with the post 3, in order to securely position the socket, the rectangular recess of the socket and the post 3 are snugly connected to each other. Therefore, when the user wants to take the socket out from the post, he or she has to pull the socket with significant force and this is not convenient for some of the users. When the post 3 is connected to a frame, the post 3 is easily removed from the molds which can be removed upward or downward to obtain the post 3. However, when the post 3 has a sliding groove which is designed to be slidably mounted to the rail on the frame, the post 3 is stripped from the molds from the direction shown by the arrowhead, there must have a slide in the sliding groove to form the sliding groove. This makes the structure of the molds to be complicated.

The present invention intends to provide a hand tool part holding device which improves the shortcomings mentioned above.

SUMMARY OF THE INVENTION

The present invention relates to a hand tool part holding device and comprises a holding member having two posts which are located corresponding to each other. Each post is a T-shaped post and has two first holding portions and a second holding portion. The two respective second holding portion of the two posts are located away from each other. Each of the posts has two first slots defined in the outside thereof, and a second slot is defined between the two posts. The second slot has two parallel sides. Each post has a first engaging portion and a second engaging portion formed on the outside thereof. The first engaging portion is located close to the distal end of the post so as to position a hand tool part. The hand tool part can be separated from the first engaging portion with a less force. The second engaging portion is an annular flange which secures the hand tool part so that the hand tool part can be separated from the second engaging portion with a larger force.

The primary object of the present invention is to provide a hand tool part holding device which holds the hand tool part in two different ways.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 2:
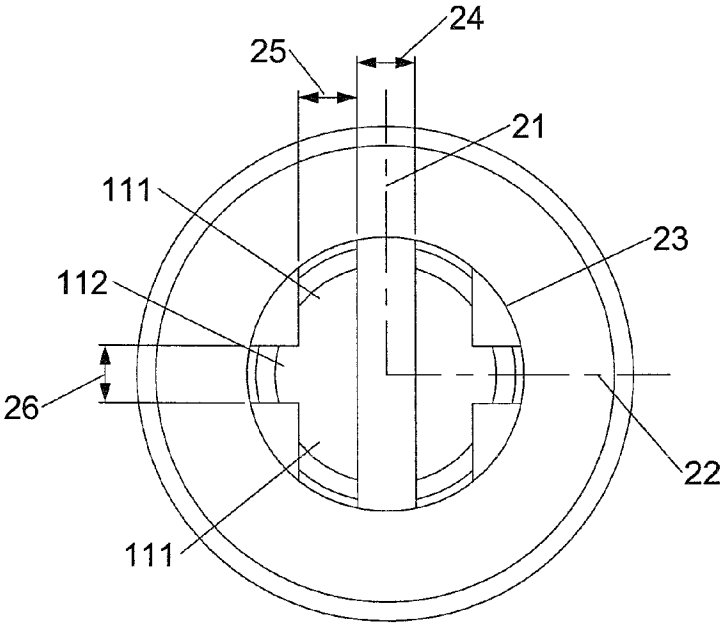
FIG. 2 is a top view to show the holding member of the present invention.
Figure 1:
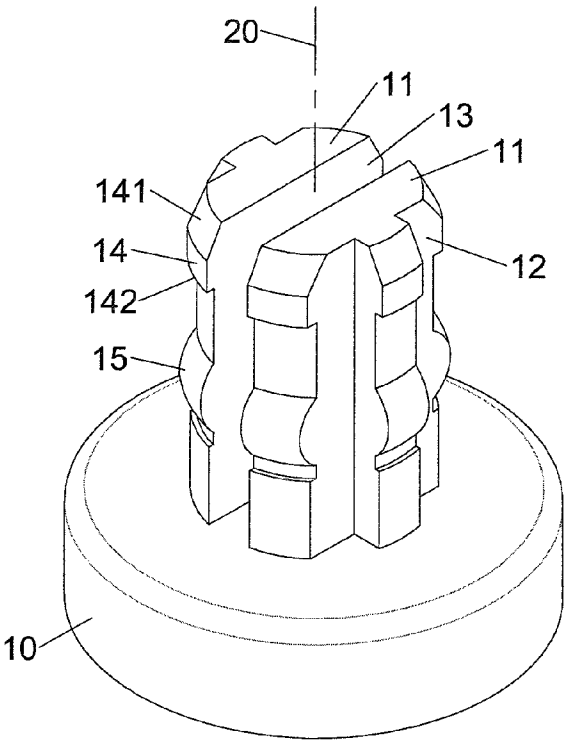
FIG. 1 is a perspective view to show the holding member of the present invention.

Referring to FIGS. 1 and 2, the hand tool part holding device of the present invention comprises a holding member 10 which is a cylindrical member and made by plastic. The holding member 10 has two posts 11 which are located corresponding to each other. Each post 11 is a T-shaped post and has two first holding portions 111 and a second holding portion 112. The two respective second holding portions 112 of the two posts 11 are located away from each other. Each second holding portion 112 of each post 11 is located between the two first holding portions 111 of each post 11. Each of the posts 11 has two first slots 12 defined in the outside thereof and the two first slots 12 separate the first holding portions 111 and the second holding portion 112. A second slot 13 is defined between the two posts 11 and has two parallel sides. The two posts 11 are located symmetrically relative to the second slot 13. Each post 11 has a first engaging portion 14 and a second engaging portion 15 formed on the outside thereof. The first engaging portion 14 is a tapered face extending from the outside of the post 11 and located close to a distal end of the post 11. The first engaging portion 14 has an inclined face 141 and a shoulder 142. The first engaging portion 14 is designed to position a hand tool part 30 mounted to the posts 11, and the hand tool part 30 can be separated from the first engaging portion 14 by a less force. The second engaging portion 15 is an annular flange which secures the hand tool part 30 which can be separated from the second engaging portion 15 by a larger force. Therefore, when hand tool part 30 is engaged with the second engaging portion 15, the hand tool part 30 does not detach from the posts 11.

As shown in FIG. 2, the holding member 10 has a central axis 20. An imaginary vertical line 21 is perpendicular to the central axis 20 and passes through the second slot 13. An imaginary horizontal line 22 is parallel to the central axis 20 and passes through the second holding portion 12. The two posts 11 are located symmetrically to each other relative to the imaginary vertical line 21. The two first slots 12 of each post 11 are located symmetrically to each other relative to the imaginary horizontal line 22. An outer face of the two posts 11 is located on an imaginary outer circle 23. As defined in in FIG. 2, the width of the second slot 13 is a first distance 24, the width of the first holding portion 111 is a second distance 25, and the width of the second holding portion 112 is a third distance 26. The first, second and third distances 24, 25, 26 are equal to each other.

Figure 3:
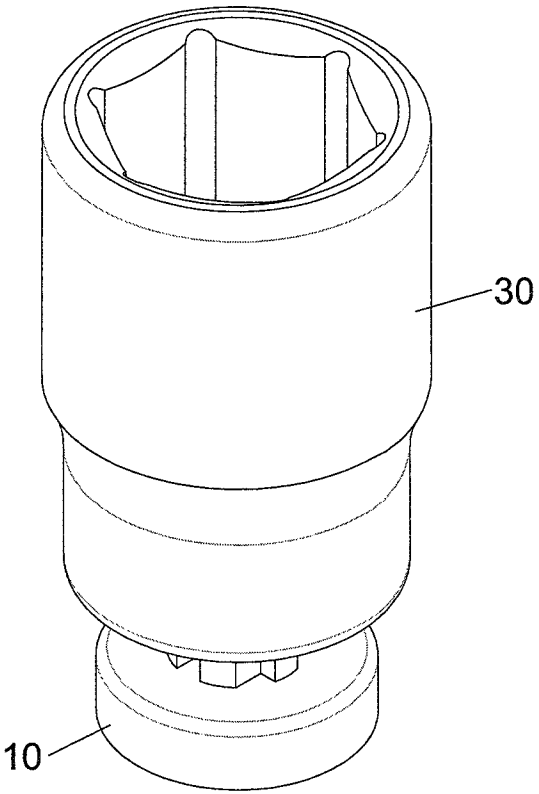
FIG. 3 is a perspective view to show that a socket is mounted to the holding member of the present invention.
Figure 4:
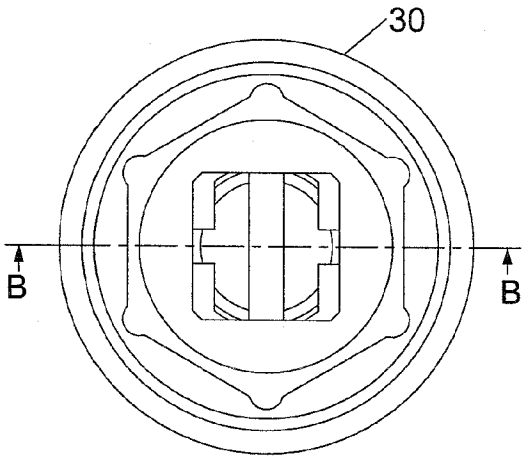
FIG. 4 is a top view to show the socket mounted to the holding member of the present invention.

As shown in FIGS. 3 and 4, the hand tool part 30 has a rectangular recess 31, and a groove 32 is defined in each inside of the rectangular recess 31. The first and second engaging portions 14, 15 are engaged with the grooves 32. The hand tool part 30 is a socket, an extension rod, a connector or a universal connector.

Figure 5:
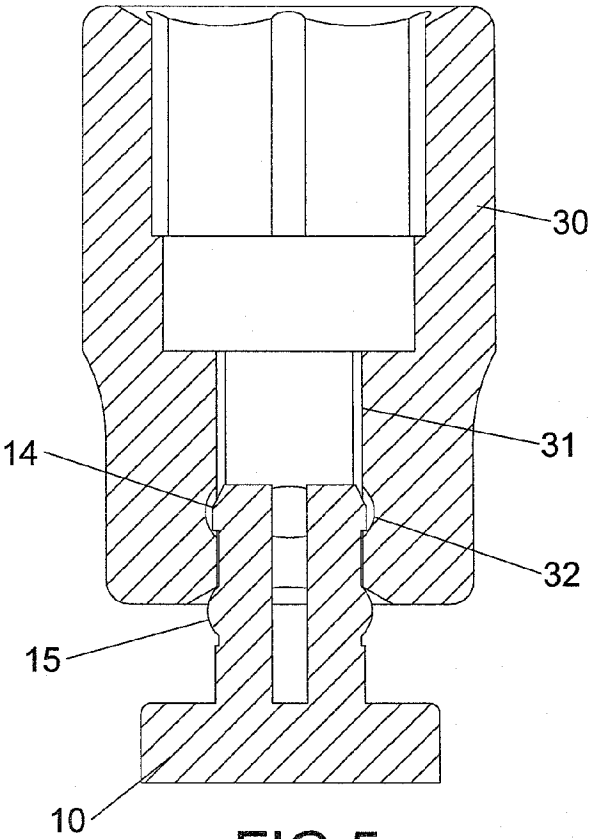
FIG. 5 is a cross sectional view, taken along line B-B in FIG. 4, wherein the socket is temporarily positioned on the holding member.

As shown in FIG. 5, when the first engaging portion 14 of the holding member 10 is engaged with the grooves 32 of the hand tool part 30, because the first engaging portion 14 is located close to the distal end of the post 11, and the distal ends of the posts 11 have better flexibility so that the hand tool part 30 can be separated from the first engaging portion 14 by a less force. In other words, if the hand tool part 30 will be used frequently, then the hand tool part 30 can temporarily positioned by the first engaging portions 14.

Figure 6:
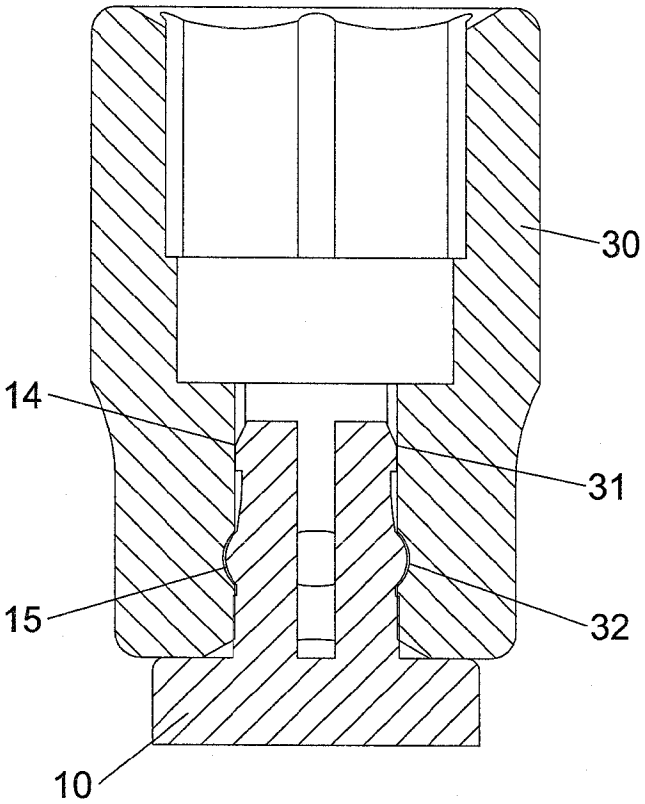
FIG. 6 is a cross sectional view, taken along line B-B in FIG. 4, wherein the socket is securely positioned on the holding member.

As shown in FIG. 6, the second engaging portion 15 is an annular flange which secures the hand tool part 30 so that it needs a larger force to separate the hand tool part 30 from the second engaging portion 15. The hand tool part 30 does not detach from the posts 11 and is conveniently stored without worry of lost.

Figure 8:
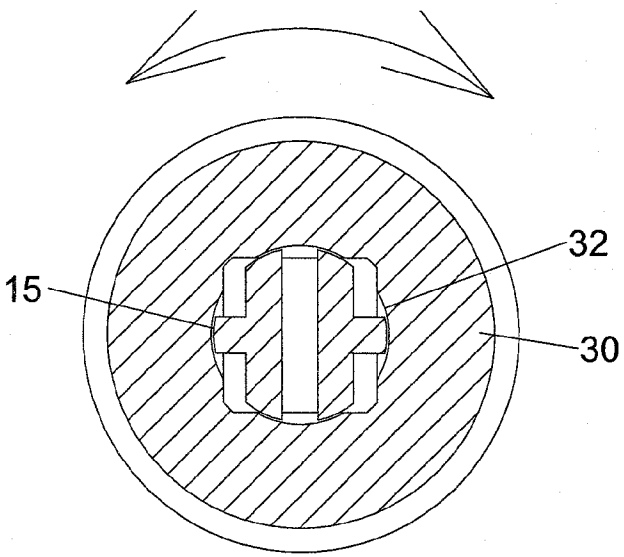
FIG. 8 is a cross sectional view, taken along line C-C in FIG. 7.
Figure 7:
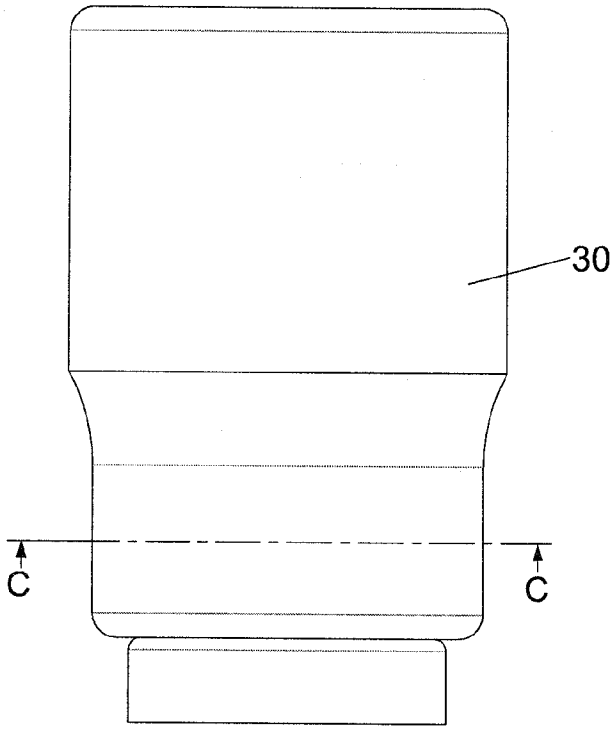
FIG. 7 is a side view to show that the socket is mounted on the holding member of the present invention.

As shown in FIGS. 7 and 8, the outer face of the two posts 11 is located on an imaginary outer circle 23, so that when the posts 11 are engaged with the grooves 32, the hand tool part 30 is freely rotatable relative to the posts 11.

Figure 9:
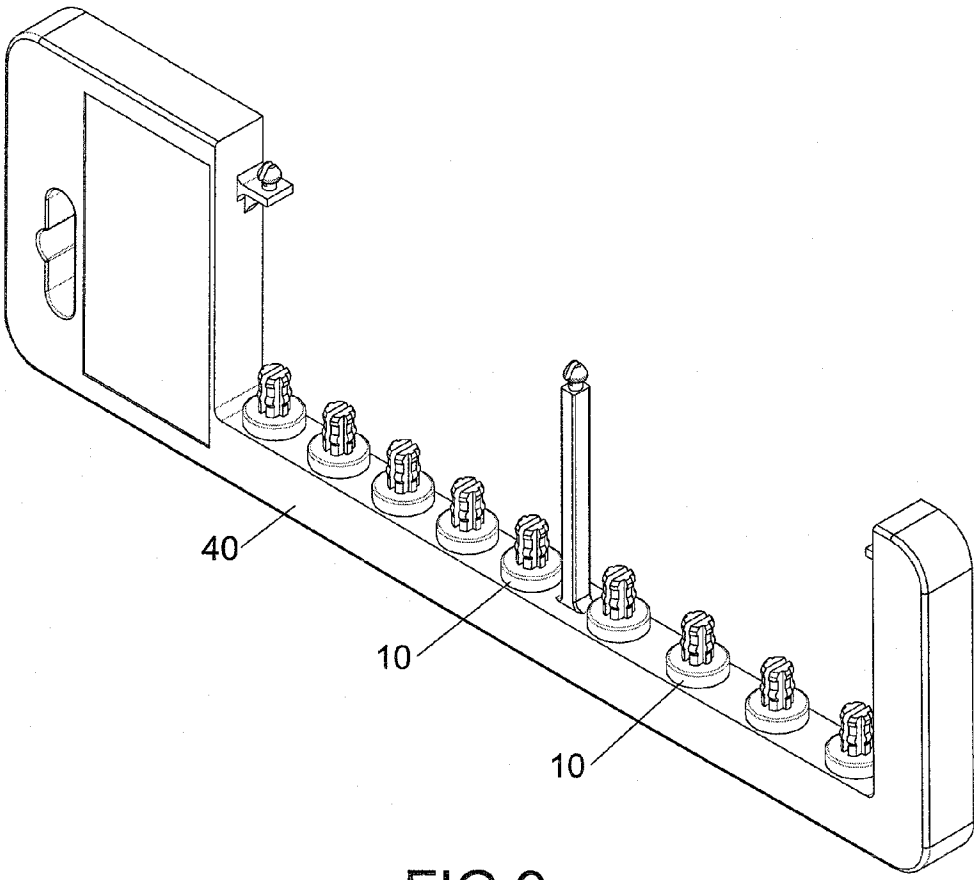
FIG. 9 shows that the first frame with multiple holding members.

As shown in FIG. 9, a first frame 40 is used which has multiple holding members 10 connected thereto so as to hold multiple hand tool parts 30.

Figure 10:
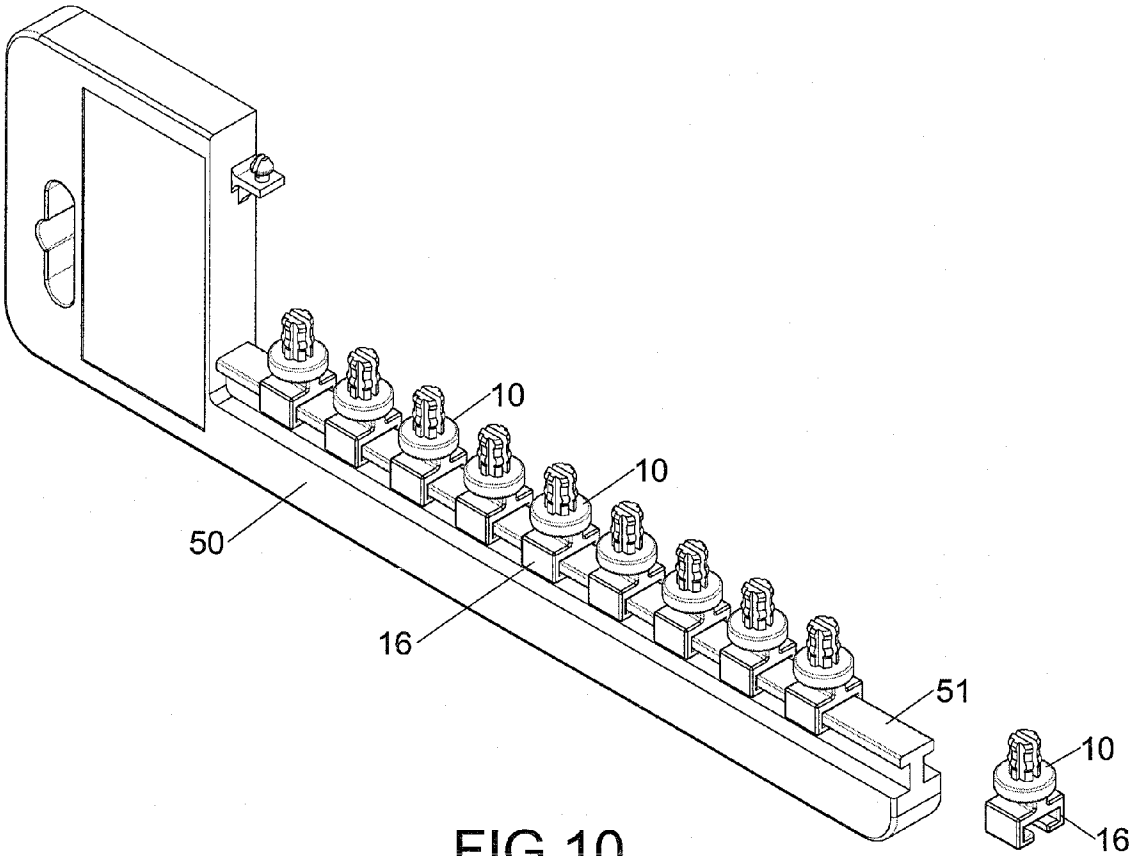
FIG. 10 that the second frame with multiple holding members.

As shown in FIG. 10, another embodiment shows that a second frame 50 is used which has a rail 51, and the rail 51 is a T-shaped rail. The holding member 10 has a sliding groove 16. The holding member 10 is slidably mounted to the rail 51 by engaging the rail 51 with the sliding groove 16. This provides flexibility to position the hand tool parts 30 t0 the holding members 10 at desired positions.

Figure 11:
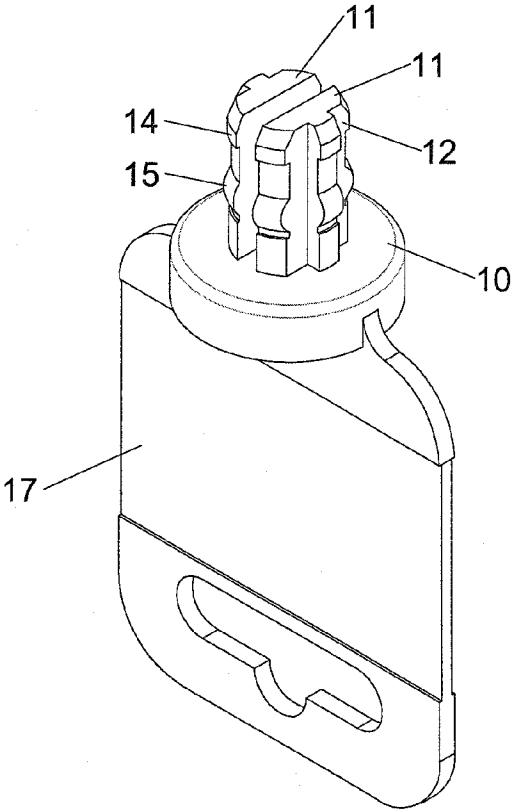
FIG. 11 shows that the holding member of the present invention has a hanging portion connected thereto.
Figure 12:
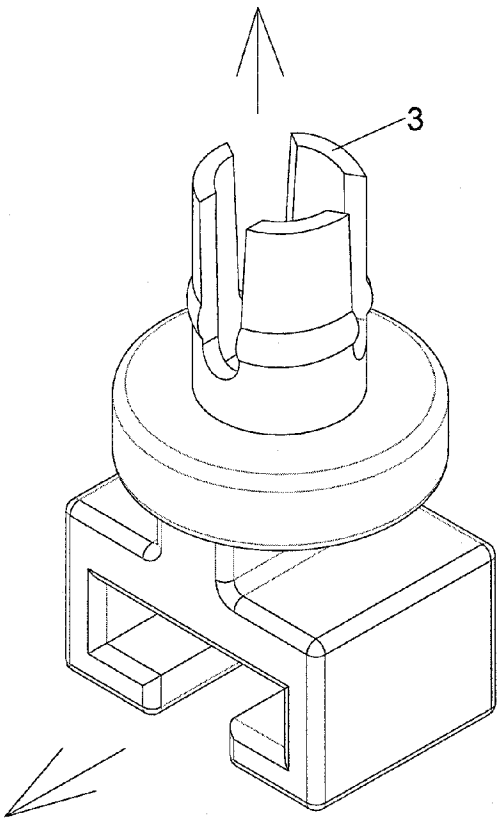
PRIOR ART FIG.12
FIG. 12 shows the conventional holding member.

FIG. 11 shows that the holding member 10 has a hanging portion 17 so that the holding member 10 can be hanged and displayed.

The present invention has the first and second engaging portions 14, 15 to provide the hand tool part 30 two different positioning features which are temporarily positioning and more securely positioning.

As shown in FIG. 1, the holding member 10 can be stripped from the molds from top, bottom, or two sides, so that the holding member 10 can be manufactured at lower cost.

As shown in FIG. 10, when the holding member 10 has the sliding groove 16, the second slot 13 and the sliding groove 16 are orientated in the same direction. Therefore, the holding member 10 can be stripped from the molds from two sides. There will be no slide needed in the molds.

While we have shown and described the embodiment in accordance with the present invention, it should be clear to those skilled in the art that further embodiments may be made without departing from the scope of the present invention.

What is claimed is:

1. A hand tool part holding device comprising:

a holding member being a cylindrical member and being made by plastic, the holding member having two posts which are located corresponding to each other, each post being a T-shaped post and having two first holding portions and a second holding portion, the two respective second holding portions of the two posts being located away from each other, the second holding portion being located between the two first holding portions, each of the posts having two first slots defined in an outside thereof and the two first slots separating the first holding portions and the second holding portion, a second slot being defined between the two posts and having two parallel sides;

each post having a first engaging portion and a second engaging portion formed on an outside thereof, the first engaging portion being a tapered face extending from the outside of the post and being located close to a distal end of the post, the first engaging portion having an inclined face and a shoulder, the first engaging portion positioning a hand tool part which is mounted to the posts, the hand tool part being separated from the first engaging portion by a first force, the second engaging portion being an annular flange which secures the hand tool part, the hand tool part being separated from the second engaging portion by a second force, wherein the second force is larger than the first force, and the holding member having a central axis, an imaginary vertical line being perpendicular to the central axis and passing through the second slot, an imaginary horizontal line being parallel to the central axis and passing through the second holding portion, the two posts being located symmetrically to each other relative to the imaginary vertical line, the two first slots of each post being located symmetrically to each other relative to the imaginary horizontal line, an outer face of the two posts being located on an imaginary outer circle, a width of the second slot being a first distance, a width of the first holding portion being a second distance, a width of the second holding portion being a third distance, wherein the first, second and third distances are equal to each other.

2. The device as claimed in claim 1, wherein the hand tool part has a rectangular recess and a groove is defined in each inside of the rectangular recess, the first and second engaging portions are alternately engaged with the grooves.

3. The device as claimed in claim 1, wherein the hand tool part is a socket.

4. The device as claimed in claim 1, wherein the hand tool part is an extension rod, a connector or a universal connector.

5. The device as claimed in claim 1 further comprising a first frame which has multiple holding members connected thereto so as to hold multiple hand tool parts.

* * * * *